US005368295A

United States Patent [19]

Severa et al.

[11] Patent Number: 5,368,295

[45] Date of Patent: Nov. 29, 1994

[54] TENNIS RACKET

[75] Inventors: William D. Severa, Addison; Frank Garrett, Barrington; Po-Jen Cheng, Oak Brook, all of Ill.

[73] Assignee: Wilson Sporting Goods Co., Chicago, Ill.

[21] Appl. No.: 71,171

[22] Filed: Jun. 2, 1993

[51] Int. Cl.[5] ..... A63B 49/02

[52] U.S. Cl. ..... 273/73 C

[58] Field of Search ..... 273/73 R, 73 C, 73 D, 273/73 G, 73 H, 73 K

[56] References Cited

U.S. PATENT DOCUMENTS

| | | | |
|---|---|---|---|
| Re. 31,419 | 10/1983 | Frolow | 273/73 C |
| Re. 33,372 | 10/1990 | Frolow | 273/73 C |
| 3,801,099 | 4/1974 | Lair | 273/73 C |
| 4,153,249 | 5/1979 | Plagenhoef | 273/73 C |
| 4,291,574 | 9/1981 | Frolow | 273/73 C X |
| 4,664,380 | 5/1987 | Kuebler | 273/73 C |
| 4,768,786 | 9/1988 | Kuebler | 273/73 C |
| 5,110,126 | 5/1992 | Knebler | 273/73 C X |
| 5,211,398 | 5/1993 | Awano et al. | 273/73 C X |

FOREIGN PATENT DOCUMENTS

| | | | |
|---|---|---|---|
| 317711 | 5/1989 | European Pat. Off. . | |
| 0340127 | 11/1989 | European Pat. Off. | 273/73 C |
| 8402817 | 4/1986 | Netherlands | 273/73 C |

*Primary Examiner*—William Stoll

[57] ABSTRACT

A tennis racket is made lighter than conventional tennis rackets yet has a higher center of percussion and a higher frequency of vibration. The head of the racket is ovoid, and the widest part of the head is above the longitudinal midpoint of the head. The longitudinal strings are fan-shaped and diverge outwardly and upwardly from the bottom of the head.

13 Claims, 3 Drawing Sheets

TENNIS RACKET

BACKGROUND

This invention relates to tennis rackets, and, more particularly, to a tennis racket which is lighter than conventional rackets yet which is stiffer and has a higher center of percussion than conventional rackets.

Frolow U.S. Pat. No. Re. 31,419 describes a racket which is lighter than the standard weight of about 12 to 14 ounces (including the weight of the strings), has a higher center of percussion, a higher center of gravity, a higher frequency of vibration, and a higher ratio of Ia/Is than conventional rackets. Specific values for the foregoing physical properties are set forth in FIG. 40. FIG. 22 illustrates a racket made from graphite fibers and epoxy which has a non-oval head shape. The upper end of the head is relatively flat and extends somewhat perpendicularly to the longitudinal axis of the racket.

Frolow U.S. Pat. No. Re. 33,372 describes additional features, including a large head racket and a weight in the handle. Specific values for certain physical properties are set forth in FIG. 15.

Kuebler U.S. Pat. No. 4,664,380 describes a racket which has the shape of a dual tapered beam in side elevation (FIG. 7). The widest or thickest part of the racket in side elevation is in the general area of the throat of the racket.

Wilson EPO Pat. No. 317,711 describes a racket having a frequency of the first mode of bending under free-free constraint between 170 Hz and 250 Hz.

Wilson Sporting Goods Co. has sold tennis rackets under the name Hammer which have some of the foregoing properties as shown in Table 1. The Hammer rackets are made from graphite fibers and resin.

frequency of a racket is related to the stiffness of the racket. A stiffer racket has a higher frequency.

I-Y is the moment of inertia about the longitudinal center line of the racket. I-Y is the same as Ia which is described in Frolow U.S. Pat. No. Re. 31,419.

I-END is the moment of inertia about an axis which extends through the butt end of the racket and perpendicularly to the longitudinal centerline. I-END is the same as Is which is described in Frolow U.S. Pat. No. Re. 31,419.

The Hammer rackets are dual taper beam rackets similar to the shape illustrated in Kuebler U.S. Pat. No. 4,664,380. The term Highest Point in Table 1 refers to the widest dimension of the side elevation of the racket. The term Highest Point at Shoulders refers to the widest dimension of the side elevational of the racket where the yoke which forms the bottom of the head of the racket merges with the side of the head.

Center of Percussion from Butt refers to the center of percussion when measured according to conventional techniques. One such technique is described in Frolow U.S. Pat. No. Re. 31,419 at column 6, lines 27–43. The number for Center of Percussion means the distance from the butt end of the racket.

SUMMARY OF THE INVENTION

A racket made in accordance with the invention is lighter than the Wilson Hammer rackets yet has a higher center of percussion, is stiffer, and has a higher frequency of vibration than a Hammer racket having a comparable cross-sectional dimension. It is surprising that a racket which is lighter than a prior racket can be made stiffer than the prior racket. A higher center of percussion is obtained by forming the head in an ovoid or ovate shape with a relatively wide end at the top of

TABLE 1

| Model | Weight (Oz.) | Balance (In.) | Si (mm) | Frequency (Hertz) | Moment of Inertia IY (Oz | $I_2$ = END In$^2$) | Highest Point (mm) | Highest Point At Shoulders (mm) | Center Percussion From Butt (In.) |
|---|---|---|---|---|---|---|---|---|---|
| Wilson Hammer 2.7si 95 | 9.72 | 15.35 | 2.7 | 198 | 89 | 2900 | 33.4 | 33.4 | 19.40 |
| Wilson Hammer 2.7si 110 | 10.05 | 15.12 | 2.7 | 194 | 104 | 2925 | 38.0 | 38.0 | 19.40 |
| Wilson Hammer 4.0si 95 | 9.72 | 15.35 | 4.0 | 178 | 89 | 2900 | 29.5 | 29.5 | 19.40 |
| Wilson Hammer 4.0si 110 | 10.05 | 15.12 | 4.0 | 176 | 104 | 2925 | 34.5 | 34.5 | 19.40 |
| Wilson Hammer 5.0si 95 | 9.72 | 15.35 | 5.0 | 162 | 89 | 2900 | 27.0 | 27.0 | 19.40 |
| Wilson Hammer 5.0si 110 | 10.05 | 15.12 | 5.0 | 160 | 104 | 2925 | 30.0 | 30.0 | 19.40 |
| Wilson Hammer Classic 5.2si 95 | 10.50 | 14.40 | 5.2 | 150 | 89 | 2900 | 22.0 | 22.0 | 19.20 |

The numbers 95 and 110 refer to the area of the string surface—95 square inches and 110 square inches, respectively. The letters si mean stiffness index and refer to the deflection of the racket when the racket extends horizontally and the grip is clamped and a weight of 2.8 kg is suspended from the tip of the racket. A stiffness index of 2.7 means that the tip of the racket deflects 2.7 mm. A stiffness index of 4.0 means that the tip of the racket deflects 4.0 mm. The 2.7 si racket deflects less and is stiffer than rackets with higher si numbers.

Balance refers to the balance point or center of gravity of the racket and is measured from the butt end of the racket.

Frequency refers to the frequency vibration of the first mode of bending under free-free constraint. That frequency is described in Wilson EPO Pat. No. 317,711, and is comparable to the frequency $F_1$ which is referred to in FIG. 40 and in column 15, lines 50–56 of Frolow U.S. Pat. No. Re. 31,419. FIG. 15 of Frolow U.S. Pat. No. Re. 33,372 also refers to the frequency $F_1$. The the racket so that more of the material of the head is positioned farther from the butt end of the racket. The frame is made from graphite fibers and resin, and less fiber and resin material is used in the handle end of the racket than at the head end of the racket so that the frame can be made lighter while still providing sufficient reinforcement and stiffness in the head of the racket.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
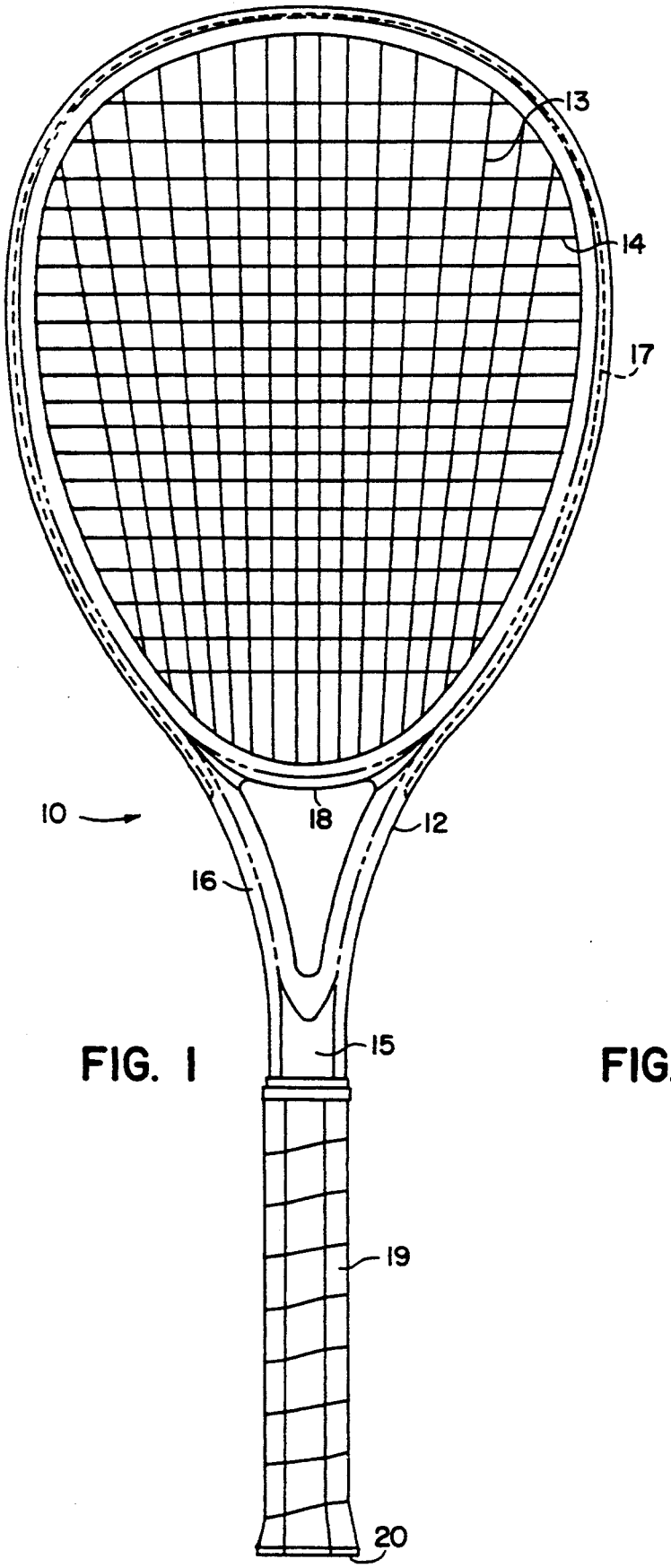
FIG. 1 is a front elevational view of a tennis racket formed in accordance with the invention which has a string area of about 95 square inches.
Figure 2:
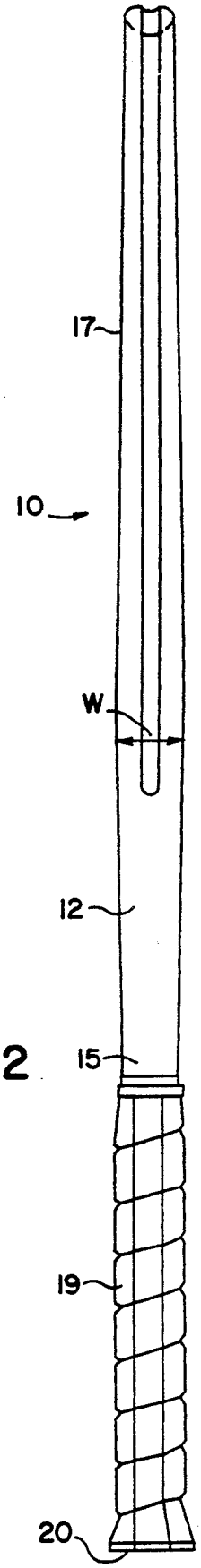
FIG. 2 is a side elevational view of the racket of FIG. 1.
Figure 3:
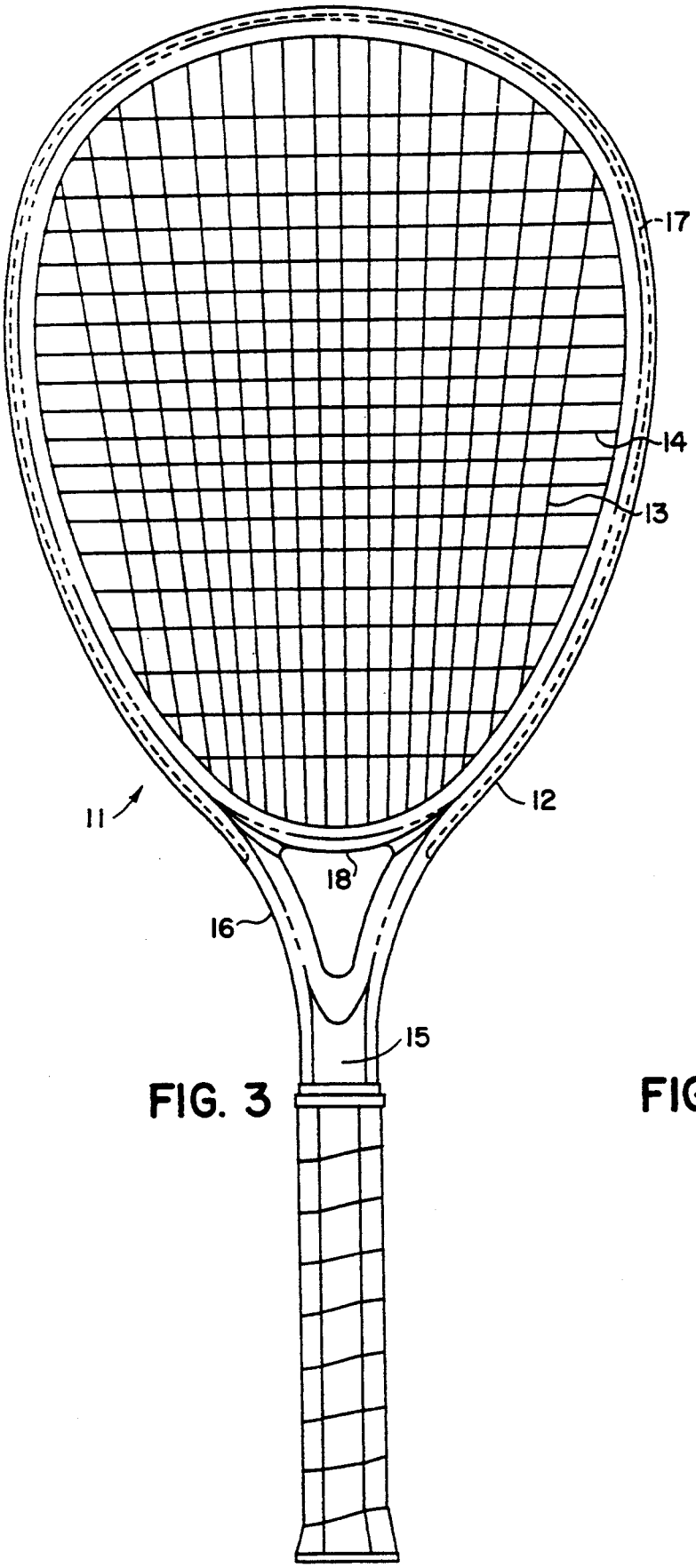
FIG. 3 is a front elevational view of a racket formed in accordance with the invention which has a string area of about 110 square inches.
Figure 4:
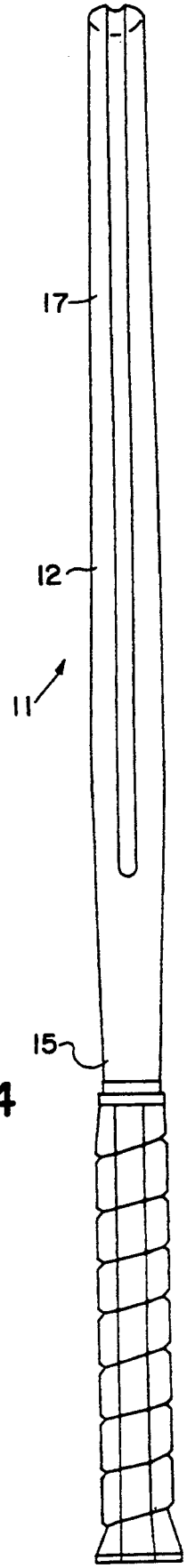
FIG. 4 is a side elevational view of the racket of FIG. 3.

FIGS. 1 and 2 illustrate a racket 10 formed in accordance with the invention which has a string area of about 95 square inches. FIGS. 3 and 4 illustrate a similar racket 11 which has a string area of about 110 square inches. Other sizes of rackets can also be made in accordance with the invention.

Each of the rackets 10 and 11 includes a frame 12 and longitudinal and transverse strings 13 and 14. The frame is formed from composite material consisting of fibers and resin. The fibers can be graphite, Kevlar, or other fibers which are conventionally used in tennis rackets. The resin is conventional resin which is used in composite tennis rackets.

Each frame 12 includes an elongated shaft portion 15, a Y-shaped throat portion 16, and a head portion 17. A yoke 18 extends between the sides of the throat and forms the bottom of the head. A grip or handle 19 is formed at the lower end of the shaft by spirally wrapped grip material, and the grip terminates in a butt end 20 at the bottom of the racket.

As can be seen from the side elevational views of FIGS. 2 and 4, the rackets 10 and 11 are dual taper beam rackets. The widest or thickest portion of the frame above the grip is indicated by the dimension W and is in the area where the yoke 18 merges with the sides of the head.

The head is ovoid or ovate shaped and is relatively wide and blunt at the top and relatively narrow and tapered at the bottom. The shape of the head permits more of the material of the head to be positioned farther away from the butt end of the racket.

Figure 5:
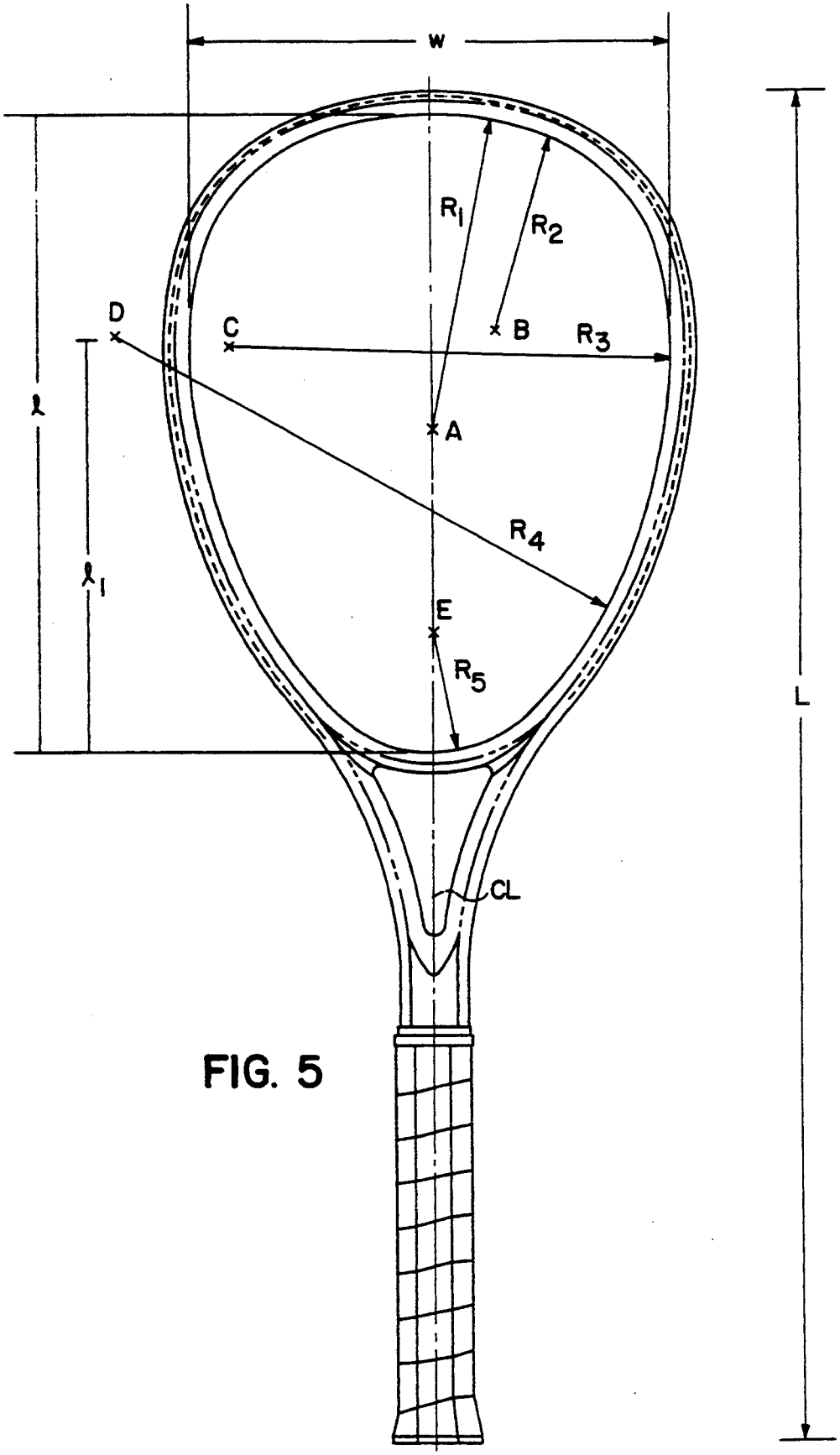
FIG. 5 is a front elevational view of the racket of FIG. 1 without strings.

Referring to FIG. 5, the racket has an overall length L, a maximum string length l in the longitudinal direction along the longitudinal centerline CL, and a maximum string width w in a direction transverse to the longitudinal centerline. The dimensions for the maximum string length and string width are taken at the inside of the head. The maximum string width is at a distance $l_1$ from the bottom of the head, and $l_1$ is greater than one-half of the maximum string length 1.

The ovoid shape of the head is provided by five radii of curvature $R_1$ through $R_5$ which are centered at points A through E, respectively. The radii of curvature $R_3$ and $R_4$ are applied to the right side of the head, and corresponding radii of curvature are applied to the left side of the head.

Specific embodiments of tennis rackets with string areas of about 95 and 110 square inches had the physical properties shown in Table II:

TABLE II

| | 95 sq. in. | 110 sq. in. |
|---|---|---|
| L | 27 inches | 27 inches |
| l | 12.734 inches | 13.703 inches |
| $l_1$ | 8.06878 inches | 8.6819 inches |
| w | 9.514 inches | 10.238 inches |
| W | 1.181 inches | 1.260 inches |
| weight (including strings | 9.2 ounces | 9.2 ounces |
| center of percussion | 20.1 inches | 20.1 inches |
| balance | 15.94 inches | 15.94 inches |
| frequency of vibration | 207 Hz | 192 Hz |
| I-Y | 89 ounce in.$^2$ | 105 ounce in.$^2$ |
| I-END | 2850 ounce in.$^2$ | 2950 ounce in.$^2$ |
| $R_1$ | 6.242 inches | 6.717 inches |
| $R_2$ | 3.567 inches | 3.838 inches |
| $R_3$ | 8.917 inches | 9.595 inches |
| $R_4$ | 10.701 inches | 11.514 inches |
| $R_5$ | 2.675 inches | 2.879 inches |

The points A–E for the 95 and 110 size rackets were located on the following coordinates, the first coordinate indicating the dimension to the right (+) or left (−) of the longitudinal centerline CL and the second coordinate indicating the distance from the top of the string area at the centerline CL:

| | 95 | 110 |
|---|---|---|
| A | 0, 6.4433 in. | 0, 6.7168 in. |
| B | 1.1702 in., 3,8056 in. | 1.2070 in., 4.1034 in. |
| C | −4.1603 in., 4.6662 in. | −4.4766 in., 5.0211 in. |
| D | −5.9436 in., 4.6662 in. | −6.3957 in., 5.0211 in. |
| E | 0, 10.0588 in. | 0, 10.8238 in. |

Each of the foregoing properties can be varied within normal manufacturing tolerances without significantly affecting the performance of the racket. The optimal values fall within the following ranges:

L: 27±½ inches, more preferably within the range of 26.88 to 27.13 inches

Weight: below 9.5 ounces, more preferably below 9.45 ounces

Center of percussion: greater than 19.5 inches, more preferably greater than 20.0 inches Balance: greater than 15.5 inches, more preferably greater than 15.55 inches Frequency: greater than 190 Hz, more preferably greater than 200 Hz for a 95 square inch racket The size and shape of the string area can also be varied while still obtaining the benefits of the invention. The maximum length 1, maximum width w, and location of the maximum width $l_1$ can be varied within the range of about ±½ inch. The tolerance of the radii of curvatures are $R_1$–$R_5$ is ±1inch, more preferably ±½ inch, and the tolerances of the coordinates of the Points A–E is ±1 inch, more preferably ±½ inch. The radius R of the top of the head is preferably at least twice the radius $R_5$ at the bottom of the head. The location of the maximum width $l_1$ is greater than one-half of the maximum string length l and more preferably at least 0.6 of the maximum string length.

Referring to FIGS. 1 and 3, the longitudinal string pattern is fan-shaped. The longitudinal strings 13 which are spaced laterally from the longitudinal centerline CL advantageously diverge outwardly and upwardly from the bottom of the head. The angle of divergence increases as the spacing of the string from the centerline increases. The spacing between the upper ends of the strings is therefore greater than the spacing at the bottom of the strings. The greater spacing in the upper portion of the head provides greater hitting power.

Rackets can be made lighter yet stiffer than prior rackets by using less fiber and resin material in the handle portion of the frame and reinforcing the head with additional fiber and resin material. The ovoid shape of the head also allows more of the weight of the head to be positioned farther from the butt end.

While in the foregoing specification a detailed description of specific embodiments of the invention was set forth for the purpose of illustration, it will be understood that many of the details herein given may be varied considerably by those skilled in the art without departing from the spirit and scope of the invention.

We claim:

1. A tennis racket comprising a frame having an elongated shaft portion and a head portion and strings supported by the head portion, the frame being formed from composite material comprising fibers and resin, the shaft terminating in a butt end and the head having top and bottom portions, the racket having a length of at least 26.5 inches, a strung weight of less than 9.5 ounces, a balance point of greater than 15.5 inches from the butt end, a center of percussion of greater than 19.5 inches from the butt end, and a frequency of vibration of the first mode of bending under free-free constraint of at least 190 Hz.

2. The tennis racket of claim 1 in which the frame has the shape of a dual tapered beam in side elevation, the widest part of the frame in side elevation being adjacent the bottom portion of the head, the frame tapering downwardly from said widest part toward the top of the head and tapering downwardly from said widest part toward the butt end of the shaft.

3. The tennis racket of claim 2 in which the width of the frame at said widest part is at least about 1.181 inches.

4. The tennis racket of claim 1 in which the weight of the racket is about 9.45 ounces or less.

5. The tennis racket of claim 4 in which the center of percussion is about 20.0 inches or more from the butt end.

6. The tennis racket of claim 4 in which the balance is about 15.55 inches or more from the butt end.

7. The tennis racket of claim 1 in which the head is generally ovoid shaped, the top of the head having a radius of curvature at least twice the radius of cuvature of the bottom of the frame, the widest part of the head being above the longitudinal midpoint of the head.

8. The tennis racket of claim 7 in which the widest part of the head is at least about 0.60 of the distance from the bottom of the head to the top of the head.

9. The tennis racket of claim 7 in which the head has a string area of about 95 square inches and the radius of curvature of the top of the head is at least about 6 to 6.5 inches.

10. The tennis racket of claim 9 in which the maximum longitudinal dimension of the string area is about $12.7 \pm \frac{1}{2}$ inch, the maximum width of the string area is about $9.5 \pm \frac{1}{2}$ inch, and the widest part of the string area is above the longitudinal midpoint of the string area.

11. The tennis racket of claim 7 in which the head has a string area of about 95 square inches and the radius of cuvature of the top of the head is at least about 6.2 to 7.2 inches.

12. The tennis racket of claim 11 in which the maximum longitudinal dimension of the string area is about $13.7 \pm \frac{1}{2}$ inch, the maximum width of the string area is about $10.2 \pm \frac{1}{2}$ inch, and the widest part of the string area is above the longitudinal midpoint of the string area.

13. The tennis racket of claim 7 in which the strings which are spaced laterally from the longitudinal centerline of the frame diverge outwardly with respect to the longitudinal centerline from the bottom of the head to the top of the head.

* * * * *

UNITED STATES PATENT AND TRADEMARK OFFICE

CERTIFICATE OF CORRECTION

PATENT NO. : 5,368,295

DATED : November 29, 1994

INVENTOR(S) : William D. Severa et al

It is certified that error appears in the above-indentified patent and that said Letters Patent is hereby corrected as shown below:

Col. 6, line 25 change "cuvature" to —curvature—.

Signed and Sealed this

Fourteenth Day of February, 1995

Bruce Lehman

*Attest:*

BRUCE LEHMAN

*Attesting Officer*

*Commissioner of Patents and Trademarks*